US008840374B2

(12) United States Patent
Garcia-Crespo et al.

(10) Patent No.: US 8,840,374 B2
(45) Date of Patent: Sep. 23, 2014

(54) ADAPTOR ASSEMBLY FOR COUPLING TURBINE BLADES TO ROTOR DISKS

(75) Inventors: Andres Jose Garcia-Crespo, Greenville, SC (US); John McConnell Delvaux, Fountain Inn, SC (US)

(73) Assignee: General Electric Company, Schenectady, NY (US)

( * ) Notice: Subject to any disclaimer, the term of this patent is extended or adjusted under 35 U.S.C. 154(b) by 414 days.

(21) Appl. No.: 13/271,635

(22) Filed: Oct. 12, 2011

(65) Prior Publication Data

US 2013/0094968 A1 Apr. 18, 2013

(51) Int. Cl.
*F04D 29/34* (2006.01)
*F01D 5/30* (2006.01)

(52) U.S. Cl.
CPC ..... *F01D 5/3007* (2013.01)
USPC ..... 416/219 R

(58) Field of Classification Search
CPC ... F01D 5/3007; F01D 5/3015; F01D 5/3023; F01D 5/303; F01D 5/3038
USPC ..... 416/215, 241 R, 220 R
See application file for complete search history.

(56) References Cited

U.S. PATENT DOCUMENTS

| | | | | |
|---|---|---|---|---|
| 4,084,922 | A * | 4/1978 | Glenn | 416/220 R |
| 4,093,399 | A * | 6/1978 | Glenn | 416/95 |
| 4,094,615 | A * | 6/1978 | Glenn | 416/215 |
| 4,111,603 | A * | 9/1978 | Stahl | 416/95 |
| 4,142,836 | A * | 3/1979 | Glenn | 416/193 A |
| 5,318,406 | A * | 6/1994 | Bardes | 416/223 A |
| 6,190,131 | B1 | 2/2001 | Deallenbach | |
| 6,521,175 | B1 * | 2/2003 | Mourer et al. | 420/448 |
| 14,668 | A1 | 1/2007 | Engle | |
| 7,648,340 | B2 * | 1/2010 | Sadler et al. | 416/223 A |
| 2010/0189556 | A1 * | 7/2010 | Propheter-Hinckley et al. | 415/200 |
| 2012/0275920 | A1 * | 11/2012 | Delvaux et al. | 416/204 R |

OTHER PUBLICATIONS

Co-Pending & Commonly Assigned U.S. Appl. No. 13/094,176, filed Apr. 26, 2011.

* cited by examiner

*Primary Examiner* — Edward Look
*Assistant Examiner* — Michael Sehn
(74) *Attorney, Agent, or Firm* — Dority & Manning, P.A.

(57) ABSTRACT

An adaptor assembly for coupling a blade root of a turbine blade to a root slot of a rotor disk is described. The adaptor assembly includes a turbine blade having a blade root and an adaptor body having an adaptor root. The adaptor body defines a slot having an open end configured to receive the blade root of the turbine blade such that the adaptor root of the adaptor body and the blade root of the turbine blade are adjacent to one another when the blade root of the turbine blade is positioned within the slot. Both the adaptor root of the adaptor body and the blade root of the turbine blade are configured to be received within the root slot of the rotor disk.

19 Claims, 4 Drawing Sheets

ADAPTOR ASSEMBLY FOR COUPLING TURBINE BLADES TO ROTOR DISKS

This invention was made with Government support under Contract No. DE-FC26-05NT42643, awarded by the Department of Energy. The Government has certain rights in the invention.

FIELD OF THE INVENTION

The present subject matter relates generally to gas turbines and, more particularly, to an adaptor assembly for coupling turbine blades to rotor disks.

BACKGROUND OF THE INVENTION

In a gas turbine, hot gases of combustion flow from an annular array of combustors through a transition piece for flow along an annular hot gas path. Turbine stages are typically disposed along the hot gas path such that the hot gases of combustion flow from the transition piece through first-stage nozzles and buckets and through the nozzles and buckets of follow-on turbine stages. Each turbine bucket generally includes an airfoil extending radially outwardly from a substantially planar platform and a blade root extending radially inwardly from the platform. The blade root of each turbine bucket is generally configured to be received within one of a plurality of circumferentially spaced root slots defined in one of the rotor disks of the turbine rotor, with each rotor disk being mounted to the rotor shaft for rotation therewith.

To improve the overall efficiency of a gas turbine, higher operating temperatures are continuously sought. However, as operating temperatures increase, the high temperature durability of the turbine components must correspondingly increase. Thus, efforts have been made to replace the use of metal in the construction of turbine buckets with the use of ceramic materials, such as ceramic matrix composite materials. As a result, many turbine buckets have been redesigned to accommodate the use of ceramic materials, such as by reshaping the blade root. For example, turbine buckets may now include dovetail-shaped roots as opposed to the fir tree-shaped roots used in metallic buckets. Unfortunately, such reshaping can lead to problems in attaching the blade root to pre-existing rotor disks installed within a gas turbine.

To address such attachment issues, attachment assemblies have been proposed for coupling turbine buckets to rotor disks. However, as of yet, such assemblies have not provided an effective means for axially retaining and/or sealing the turbine bucket within the assembly.

It would also be desirable to remove sealing features from turbine blades. Accordingly, an adaptor assembly for coupling a turbine bucket or blade to a rotor disk that provides for effective axial retention and/or sealing of the turbine blade within the assembly would be desirable.

BRIEF DESCRIPTION OF THE INVENTION

Aspects and advantages of the invention will be set forth in part in the following description, or may be obvious from the description, or may be learned through practice of the invention.

In one aspect, the present subject matter discloses an adaptor assembly for coupling a blade root of a turbine blade to a root slot of a rotor disk. The adaptor assembly includes a turbine blade having a blade root and an adaptor body having an adaptor root. The adaptor body defines a slot having an open end configured to receive the blade root of the turbine blade such that the adaptor root of the adaptor body and the blade root of the turbine blade are adjacent to one another when the blade root of the turbine blade is positioned within the slot. Both the adaptor root of the adaptor body and the blade root of the turbine blade are configured to be received within the root slot of the rotor disk.

In another aspect, the present subject matter discloses a gas turbine rotor system. The gas turbine rotor system includes a rotor disk having a root slot, a turbine blade having a blade root, and an adaptor assembly having an adaptor root. The adaptor assembly defines a slot having an open end in which the blade root of the turbine blade is positioned such that the adaptor root of the adaptor body and the blade root of the turbine blade are adjacent to one another. Both the adaptor root of the adaptor body and the blade root of the turbine blade are positioned within the root slot of the rotor disk.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
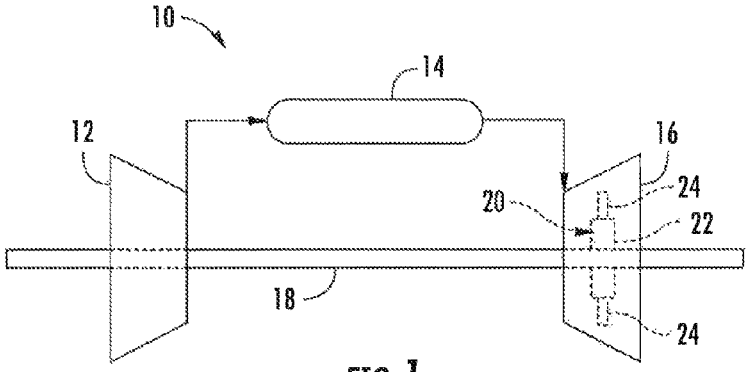
FIG. 1 illustrates a simplified, schematic diagram of one embodiment of a gas turbine.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter discloses an adaptor assembly for coupling a turbine blade (e.g., a turbine bucket) to a rotor disk of the turbine rotor. The adaptor assembly may generally include an adaptor body having an adaptor root configured to be coupled to the rotor disk and an adaptor slot configured to axially receive a blade root of the turbine blade. Both the adaptor root of the adaptor body and the blade root of the turbine blade are configured to be received within the root slot of the rotor disk. As such, the adaptor assembly may be used in retrofit applications to allow newly designed turbine blades to be coupled to pre-existing rotor disks.

Referring now to the drawings, FIG. 1 illustrates a schematic diagram of a gas turbine 10. The gas turbine 10 generally includes a compressor section 12, a plurality of combustors (not shown) disposed within a combustor section 14, and a turbine section 16. Additionally, the system 10 may include a shaft 18 coupled between the compressor section 12 and the turbine section 16. The turbine section 16 may generally include a turbine rotor 20 having a plurality of rotor disks 22 (one of which is shown) and a plurality of turbine blades 24 extending radially outwardly from and being coupled to each rotor disk 22 for rotation therewith. Each rotor disk 22 may, in turn, be coupled to a portion of the shaft 18 extending through the turbine section 16.

During operation of the gas turbine 10, the compressor section 12 supplies compressed air to the combustors of the combustor section 14. Air and fuel are mixed and burned within each combustor and hot gases of combustion flow in a hot gas path from the combustor section 14 to the turbine section 16, wherein energy is extracted from the hot gases by the turbine blades 24. The energy extracted by the turbine blades 24 is used to rotate to the rotor disks 22 which may, in turn, rotate the shaft 18. The mechanical rotational energy may then be used to power the compressor section 12 and generate electricity.

Figure 2:
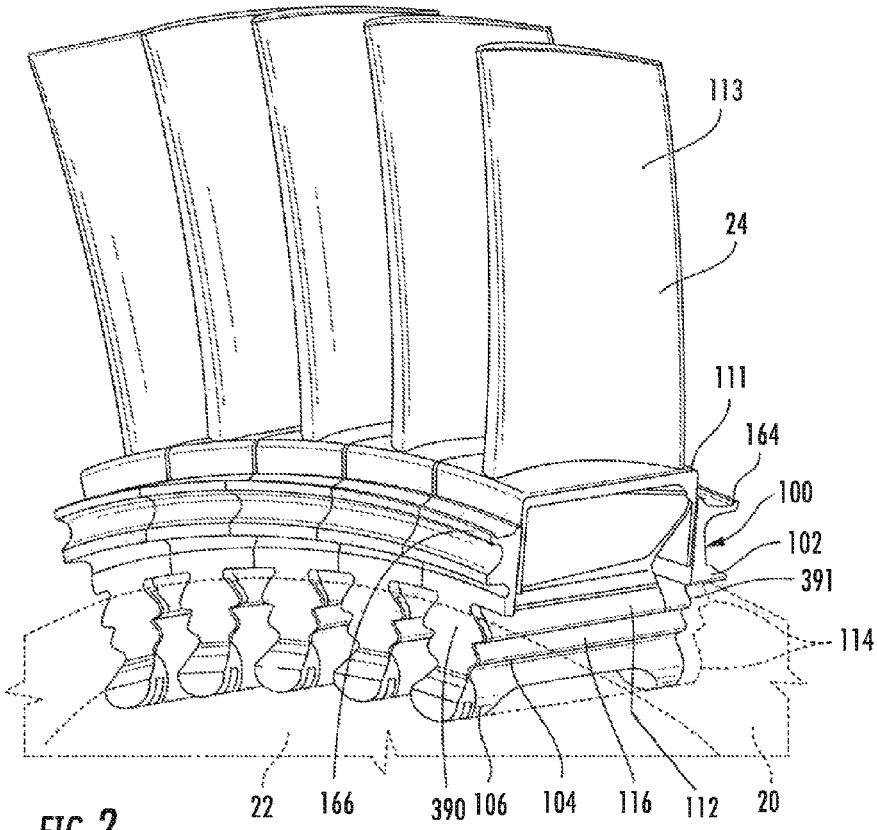
FIG. 2 illustrates a perspective view of one embodiment of an adaptor assembly for coupling a turbine blade to a rotor disk in accordance with aspects of the present subject matter.
Figure 3:
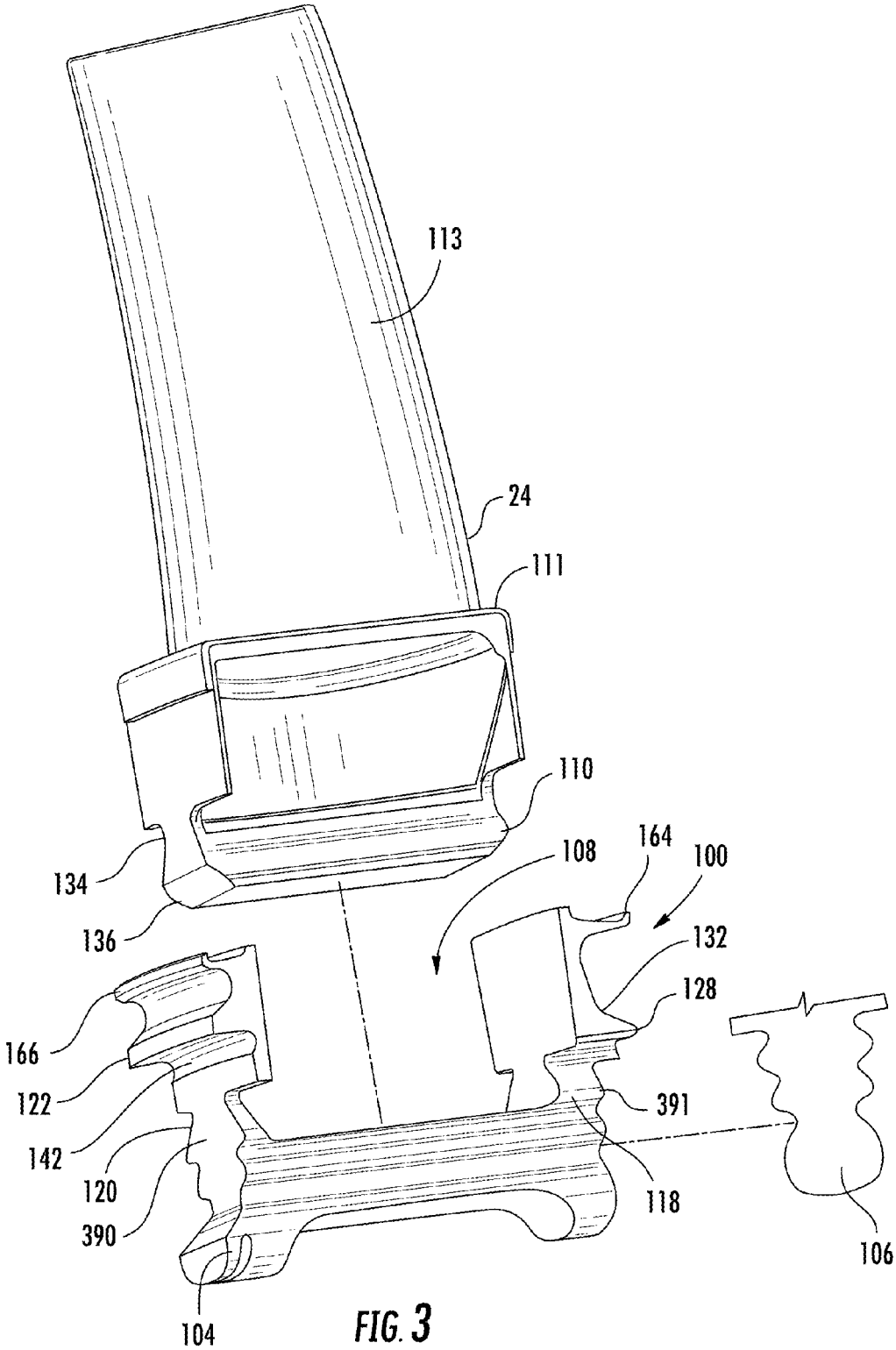
FIG. 3 illustrates an exploded view of the adaptor assembly shown in FIG. 2.
Figure 4:
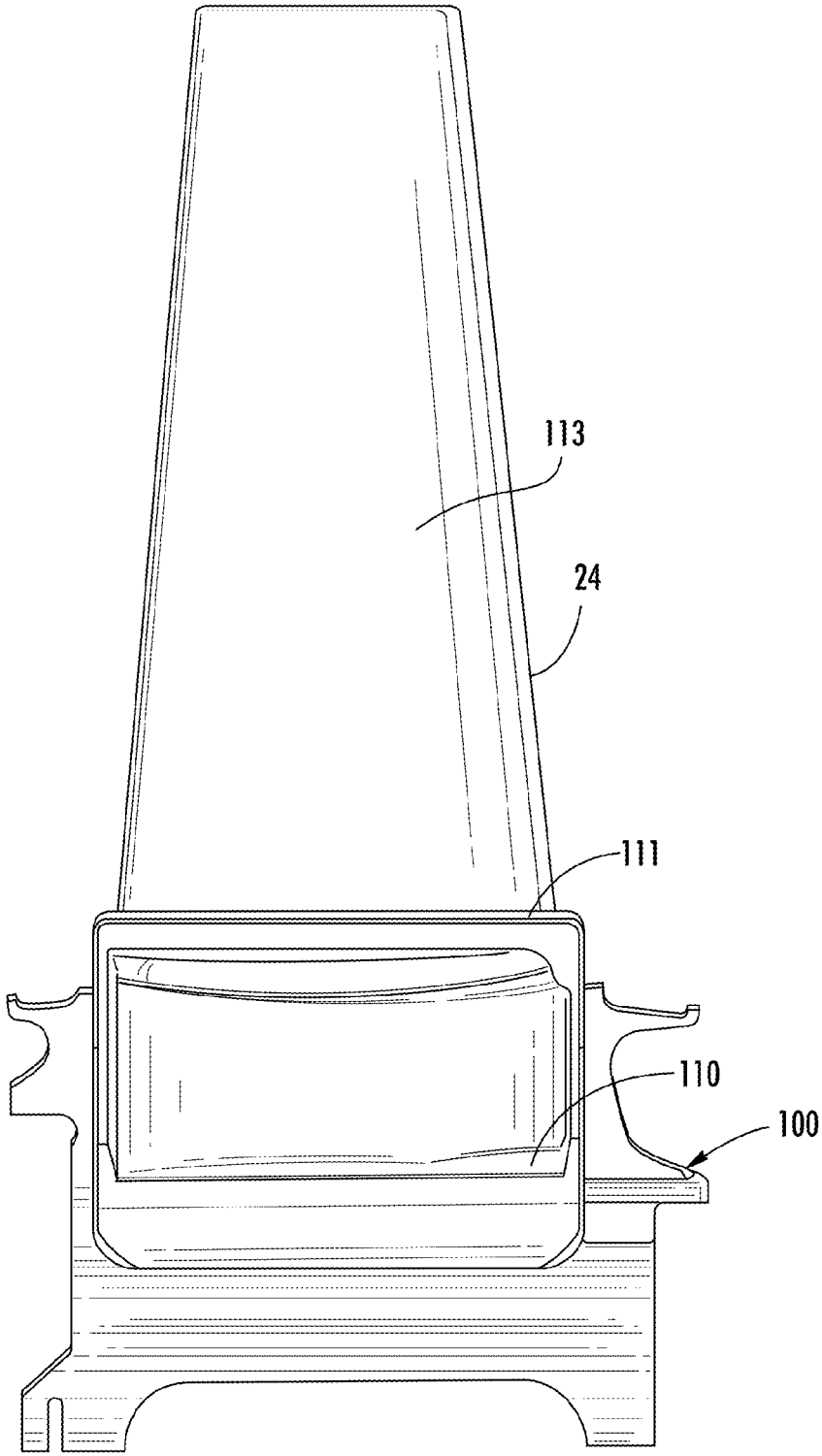
FIG. 4 illustrates a partial, side view of the adaptor assembly shown in FIG. 2.

Referring now to FIGS. 2-4, there are illustrated various views of one embodiment of an adaptor assembly 100 for coupling turbine blades 24 to one of the rotor disks 22 of the turbine rotor 20 in accordance with aspects of the present subject matter. In particular, FIG. 2 illustrates a perspective view of the adaptor assembly 100 coupled between the turbine blade 24 and the rotor disk 22. FIG. 3 illustrates an exploded view of the adaptor assembly 100 and turbine blade 24 shown in FIG. 2. Additionally, FIG. 4 illustrates a partial, side view of the adaptor assembly 100 and the turbine blade 24 shown in FIG. 2, particularly illustrating the turbine blade 24 coupled within the adaptor assembly 100.

As shown, the disclosed adaptor assembly 100 may generally comprise an attachment piece for coupling turbine blades 24 to one of the rotor disks 22 (only a portion of which is shown in FIG. 2) of the turbine rotor 20. In particular, the adaptor assembly 100 may be configured to allow turbine blades 24 having one attachment configuration to be coupled to rotor disks 22 having a different attachment configuration. Thus, in several embodiments, the adaptor assembly 100 may include an adaptor body 102 having attachment features generally corresponding to the attachment features of the turbine blade 24 and the rotor disk 22. For example, the adaptor body 102 may include an adaptor root 104 configured to be received within one of a plurality circumferentially spaced root slots 106 defined in the rotor disk 22 and an adaptor slot 108 configured to receive a blade root 110 of the turbine blade 24.

It should be appreciated that the turbine blade 24 described herein may generally be configured similarly to any suitable turbine blade known in the art. Thus, the blade root 110 may be configured to extend radially inwardly from a substantially planar platform 111 defining the radially inner boundary of the hot gases of combustion flowing through the turbine section 16 of the gas turbine 10. Additionally, the turbine blade 24 may include an airfoil 113 extending radially outwardly from the platform 111.

In general, the adaptor root 104 may comprise a radially inwardly extending portion of the adaptor body 102 having a shape and/or profile generally corresponding to the shape and/or profile of the root slots 106 defined in the rotor disk 22. For example, in one embodiment, the root slots 106 of the rotor disk 22 may have a conventional fir tree-type configuration and may include one or more pairs of axially extending grooves 114. In such an embodiment, as shown in FIG. 2, the adaptor root 104 may have a similar fir tree-type configuration and may include one or more pairs of axially extending tangs or lobes 116 generally configured to mate with the grooves 114 defined in the root slots 106. As such, the adaptor root 104 may be configured to be axially inserted within one of the root slots 106, thereby allowing the adaptor body 102 to be coupled to and rotate with the rotor disk 22. Similarly, blade root 110 of the turbine blade 24 may have a similar fir tree-type configuration and may include one or more pairs of axially extending tangs or lobes 112 configured to be axially inserted within one of the root slots 106. It should be appreciated that, in alternative embodiments, the root slots 106 and adaptor root 104 and/or blade root 110 may have any other suitable attachment configuration known in the art. For instance, in one embodiment, the root slots 106 and adaptor root 106 may have corresponding dovetail-type attachment features.

The adaptor slot 108 may generally be defined in the adaptor body 102 radially outwardly from the adaptor root 104. For example, as shown in FIG. 3, the adaptor body 102 may include a first side 118 and a second side 120 extending radially outwardly from the adaptor root 104, with the adaptor slot 108 being defined within the adaptor body 102 between the first and second sides 118, 120. Additionally, the adaptor slot 108 may generally be configured to extend axially within the adaptor body 102 to form retaining walls 122, 128 which extend tangentially between the first and second sides 118, 120 of the adaptor body 102. At least a portion 390, 391 of each retaining walls 122, 128 can have a profile that is substantially identical to the profile of the one or more blade root lobes 112 and/or one or more root slots that are adjacent thereto such as when blade root 110 is positioned in slot 108. For instance, such portions 390, 391 can each have a width that is less than or equal to the width of the blade root lobe(s) and/or root slot(s) so that each portion can be inserted into root slot(s) without obstructing entry. As such, the turbine blade 22 may be coupled to the adaptor body 102 by radially inserting the blade root 110 into the adaptor slot 108. In addition, the retaining walls 122, 128 may generally serve as axial stops for the turbine blade 24 and, thus, may provide a means for axially retaining and/or sealing the blade root 110 within the adaptor slot 108.

Additionally, the adaptor slot 108 may generally be configured to have a shape and/or profile corresponding to the shape and/or profile of the blade root 110. For example, as shown in FIG. 3, the blade root 110 has a fir tree-type features including a narrowed neck 134 and a lobe 136 diverging outwardly from the neck 134. Thus, the adaptor slot 108 may generally have a similar fir tree-type configuration and may define a shape and/or profile configured to receive the neck 134 and diverging lobe 136 of the blade root 110. However, in alternative embodiments, the blade root 110 and adaptor slot 108 may have any other suitable attachment configuration known in the art.

Figure 5:
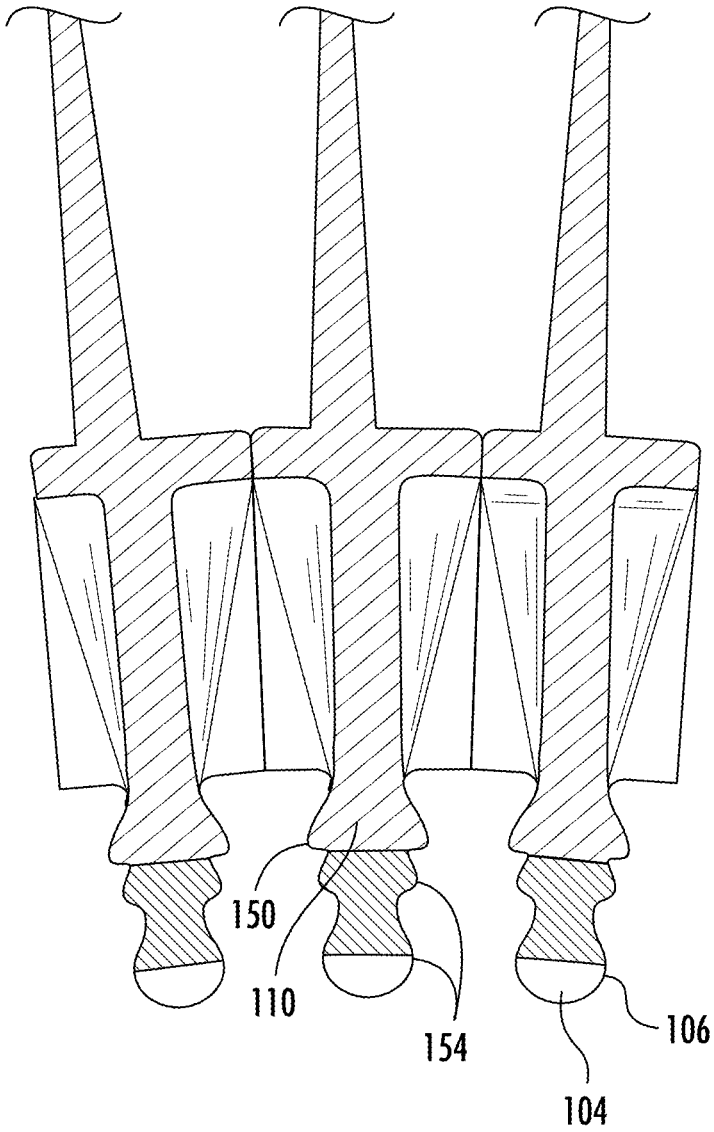
FIG. 5 illustrates a cross-sectional view of the adaptor assembly shown in FIG. 2.

In this manner, adaptor slot 108 can receive blade root 110 radially and blade root 110 and adaptor root 104 can then axially slide into root slots 106. Referring to FIG. 5, root slots 106 can include one or more top lobes 150 and one or more bottom lobes 154. Top lobes 150 are configured to accept blade root 110 while bottom lobes are configured to accept adaptor root 104.

Referring again to FIGS. 2-4, in several embodiments of the present subject matter, the adaptor assembly 100 may include one or more angel wings 164, 166 configured to provide radial sealing between the rotating components coupled to the rotor disk 22 (e.g., the adaptor assembly 100 and/or the turbine blade 24) and the stationary components (not shown) disposed forward and aft of such rotating components so as to prevent hot gas ingestion within the wheel space (not shown) adjacent to the rotor disk 22. For example, as shown in the illustrated embodiment, retaining walls 122, 128 may include angel wings 166, 164, respectively. Specifically as shown in FIG. 4, a first angel wing 166 may extending axially from the front face 142 of retaining wall 122 and a second angel wing 164 may extend axially from the back face 132 of retaining wall 128. In another embodiment, retaining walls 122, 128 may each include two or more outwardly extending angel wings 164, 166. Alternatively, only one of the retaining walls 122, 128 may include one or more angel wing(s) 164, 166 extending outwardly therefrom.

The present disclosure permits utilization of ceramic matrix composite materials for turbine blade components such as the blade root while the adaptor assembly can be formed from less expensive metal allows. Efforts have been made to replace the use of metal in the construction of turbine buckets with the use of ceramic materials, such as ceramic matrix composite materials or monolithic ceramic. As a result, many turbine buckets have been redesigned to accommodate the use of ceramic materials, such as by reshaping the blade root. Unfortunately, such reshaping can lead to problems in attaching the blade root to pre-existing rotor disks installed within a gas turbine. By utilizing the present disclosure, the blade root can be formed from desired materials while still being capable of attachment to pre-existing rotor disks or with new designs while keeping the ceramic while keeping the ceramic blade construction as simple as possible.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An adaptor assembly for coupling a blade root of a turbine blade to a root slot of a rotor disk, the adaptor assembly comprising:

a turbine blade comprising a blade root; and an adaptor body comprising an adaptor root, the adaptor body defining a slot having an open end configured to receive the blade root of the turbine blade such that the adaptor root of the adaptor body and the blade root of the turbine blade are adjacent to one another when the blade root of the turbine blade is positioned within the slot; and wherein the adaptor root of the adaptor body and the blade root of the turbine blade are each configured to be received within the root slot of the rotor disk and are each configured to mate and make contact with the root slot of the rotor disc.

2. The adaptor assembly of claim 1, wherein the slot defined by the adaptor body comprises one or more walls having a width that is less than or equal to the width of the blade root, root slot, or combinations thereof.

3. The adaptor assembly of claim 1, wherein the turbine blade comprises a ceramic matrix composite, metal alloy, or monolithic ceramic.

4. The adaptor assembly of claim 1, wherein the blade root of the turbine blade comprises a ceramic matrix composite, metal alloy, or monolithic ceramic.

5. The adaptor assembly of claim 1, wherein the adaptor body comprises a metal alloy.

6. The adaptor assembly of claim 1, wherein the adaptor root comprises a metal alloy.

7. The adaptor assembly of claim 1, wherein the blade root of the turbine blade comprises a ceramic matrix composite and the adaptor body comprises a metal alloy.

8. The adaptor assembly of claim 1, further comprising at least one angel wing extending from the adaptor body.

9. The adaptor assembly of claim 1, further comprising two or more angel wings extending from the adaptor body.

10. The adaptor assembly of claim 1, wherein the profile defined by the adaptor root of the adaptor body and the blade root of the turbine blade when the blade root of the turbine blade is positioned within the slot is substantially identical to the profile defined by the root slot.

11. A gas turbine rotor system comprising:

a rotor disk comprising a root slot;

a turbine blade comprising a blade root; and an adaptor assembly comprising an adaptor body and an adaptor root, the adaptor body defining a slot having an open end in which the blade root of the turbine blade is positioned such that the adaptor root of the adaptor body and the blade root of the turbine blade are adjacent to one another; and wherein the adaptor root of the adaptor body and the blade root of the turbine blade are each positioned within the root slot of the rotor disk and mated to and in contact with the root slot of the rotor disk.

12. The gas turbine rotor system of claim 11, wherein the root slot comprises two or more lobes including a bottom lobe and a top lobe.

13. The gas turbine rotor system of claim 12, wherein the adaptor root is positioned within at least the bottom lobe of the root slot and the blade root is positioned within at least the top lobe of the root slot.

14. The gas turbine rotor system of claim 11, wherein the slot defined by the adaptor body comprises one or more walls having a width that is less than or equal to the width of the blade root, root slot, or combinations thereof.

15. The gas turbine rotor system of claim 11, wherein the turbine blade comprises a ceramic matrix composite, metal alloy, or monolithic ceramic.

16. The gas turbine rotor system of claim 11, wherein the blade root of the turbine blade comprises a ceramic matrix composite, metal alloy, or monolithic ceramic.

17. The gas turbine rotor system of claim 11, wherein the adaptor body comprises a metal alloy.

18. The gas turbine rotor system of claim 11, wherein the adaptor root comprises a metal alloy.

19. The gas turbine rotor system of claim 11, wherein the blade root of the turbine blade comprises a ceramic matrix composite and the adaptor body comprises a metal alloy.

* * * * *